United States Patent [19]

Biek

[11] Patent Number: 4,813,492

[45] Date of Patent: Mar. 21, 1989

[54] LOW PRESSURE SHUT OFF DEVICE CONTAINED WITHIN A PNEUMATIC TOOL

[75] Inventor: Paul A. Biek, Houston, Tex.

[73] Assignee: Dresser Industries, Inc., Dallas, Tex.

[21] Appl. No.: 85,714

[22] Filed: Aug. 17, 1987

[51] Int. Cl.[4] ..... B25B 23/151

[52] U.S. Cl. ..... 173/2; 137/456; 137/624.27; 81/470

[58] Field of Search ..... 173/2, 8, 9, 11, 12; 408/5, 8–10, 130; 81/470, 57.44; 137/456, 624.27; 91/425, 426

[56] References Cited

U.S. PATENT DOCUMENTS 3,650,297 3/1972 Hubbard ..... 137/624.27

3,970,151 7/1976 Workman, Jr. ..... 173/12

*Primary Examiner*—Frank T. Yost

*Assistant Examiner*—James L. Wolfe

[57] ABSTRACT

The invention provides a low pressure shut off device contained within a pneumatic tool that senses the air pressure of an air stream supplied to a pneumatic motor and shuts off the air flow when the pressure falls below a predetermined level set to maintain consistent performance of the tool and to avoid damage to the tool or to the workpiece. The invention includes a throttle valve, a throttle piston that moves to open and close the valve, and a device for sensing the air pressure of the supply stream, holding the throttle valve open when the pressure is sufficient and closing it when the supply pressure is insufficient. The invention may also be used in combination with an air control system within a pneumatic tool such that the sensing device shuts off the flow of air to the air control system as well as the motor when the air control system pressure is insufficient.

20 Claims, 1 Drawing Sheet

LOW PRESSURE SHUT OFF DEVICE CONTAINED WITHIN A PNEUMATIC TOOL

TECHNICAL FIELD

This invention relates to a device contained within a pneumatic tool that senses incoming air pressure and shuts off the air flow to the tool when the supply air pressure becomes too low.

BACKGROUND

One of the problems encountered in using pneumatic tools is maintaining an adequate air supply to the motor. Low supply pressure can be caused by several things: restricted hoses, leaky couplings, extra long hoses, or excess demand on the system. When the supply pressure is too low, pneumatic tools may malfunction causing damage to the tool or to the workpiece, or the tools may perform inadequately. For example, a pneumatic screwdriver or nutrunner may not maintain the required torque in tightening if the supply air pressure is too low. Also, some pneumatic tools have air operated clutches, gear shifts, control valves, depth sensing retract controls and other air pressure operated components requiring air pressure to be controlled within a suitable range and above a certain minimum pressure to insure proper function. It would be better for the tools to be shut down completely when the supply pressure is too low than to operate at less than a desired supply level. Pneumatic tools need the safeguard of some device to shut off the air supply when the pressure becomes too low thereby shutting down the pneumatic tool.

In the past, one method of providing this safeguard was to use a cut-off valve at a control panel remote from the air motor. Since this control was remote, it would not sense the pressure of the air supply actually reaching the tool. Also, a remote device may not be utilized by the operator as desired by the tool manufacturer. Therefore, a need existed for a built-in device that would shut off the air supply when the pressure was insufficient.

In addition, it would also be beneficial if the air flowing through a built-in pressure sensing device would be supplied to the air operated components, e.g. clutches, gear shifts, etc., through a single air line or manifold. Thus, the air control system would be at a uniform pressure throughout and this pressure would be simultaneously present at the pressure sensing device. This is desireable since the pressure sensing device would be monitoring the actual pressure supplied to the air operated components. Also if the pressure should drop within the air control system due to a low supply pressure, intentional venting by a "motor stop" signal valve, intentional venting by a built-in or remote "stop button", excessive leakage, or for any other reason, the pressure sensing device would shut off the air supply to the motor and to the air control system.

SUMMARY OF THE INVENTION

Accordingly, the present invention provides a pressure sensing device that can be contained within a pneumatic tool or otherwise used in combination with a pneumatic motor that monitors the air pressure to the tool and shuts off the incoming air to the motor and to any air control system that may be used in the tool when the pressure falls below a predetermined level. Also, the device may be used to supply air to an air control system with air powered components using a small volume of air flowing through a single air line or manifold. The air control system and the pressure sensing device of the present invention are simultaneously at the same pressure. If the pressure in the air control system falls below a desired level, due either to intentional venting or inadvertent leakage or venting, both the air supply to the motor and to the air control system are shut off.

Use of the invention prevents damage to the motor, tool or workpiece that may be caused by running the tool at too low a pressure. The present invention also provides a means for shutting down the motor by simply venting air from the sensing device or air control system.

The invention includes means for sensing air pressure, holding an inlet valve open when the pressure is sufficient, and closing the inlet valve when the pressure is insufficient. In one embodiment, the invention includes a throttle valve associated with a throttle spring that biases the throttle valve to a closed position. The throttle valve is controlled by a throttle piston which is movable against a spring from a closed position to an open position. A pressure sensing device is associated with the throttle piston and acts on the piston to close the throttle valve when the pressure is below a specified level.

In one embodiment of the invention, the pressure sensing device includes a latch piston slidably mounted within a latch cylinder with the latch piston acting against a compression spring. Attached to a latch piston is a latch rod that is positioned such that it may be inserted within a detent recess in the throttle piston when the throttle piston is in the open position. Air is supplied to the latch cylinder intermittently during start up and directly from the feed stream by a passageway and through a metering orifice after start up. When the throttle piston is in the open position, a sufficient pressure in the latch cylinder will force the latch piston against the spring, and the latch rod secures the throttle piston in the open position. If the air pressure becomes too low, the spring forces the latch piston to move within the cylinder such that the latch rod withdraws from the detent in the throttle piston. This allows the throttle piston to return to the closed position thereby closing the throttle valve.

A preferred embodiment of the invention includes start-up means to open the throttle valve initially. The same start up means may be used to restart the tool when the air pressure has returned to the desired level. The start-up means may include an air passage to temporarily pressurize the throttle piston cavity and the latch piston cavity, thereby opening the throttle valve and latching it in position.

In another embodiment, the present invention includes the use of the pressure sensing device in combination with an air control system within a pneumatic tool. The air control system may include air operated components such as valves and pistons to operate gears, clutches, etc. in the operation of the tool. The air control system is supplied air from the sensing device through a single line or manifold. Thus, the pressure within the air control system is the same as that experienced by the sensing device.

The present invention may be included within a portable pneumatic tool such as a drill, a screwdriver or a nut-runner. The sensing device of the present invention is especially suited for use within an automatic drill.

BRIEF DESCRIPTION OF THE DRAWING

The foregoing and additional objects and advantages of the invention will be more apparent when the following detailed description is read in conjunction with the accompanying drawing, wherein like reference characters denote like parts in all views and wherein.

DETAILED DESCRIPTION

Figure 1:
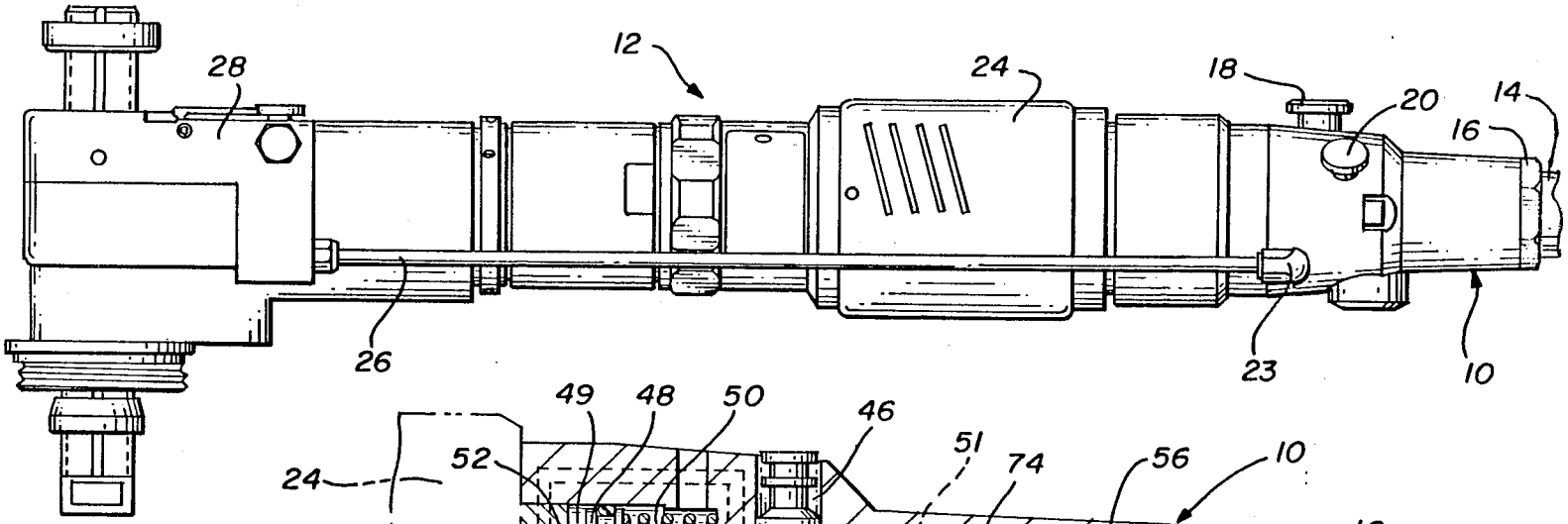
FIG. 1 is an environmental view showing the incorporation of the invention into an automatic air driven drill.

The invention involves a device that shuts off the flow of air to a pneumatic motor and to an air control system when the air pressure falls below a desired level. According to the invention, this device may be contained within a pneumatic tool so as to accurately sense the pressure available for operation. Referring to the drawing, FIG. 1 shows the shut off device indicated as 10 incorporated within an automatic drill 12. The shut off device 10 is shown built within the housing of drill 12 at the end adjacent to an incoming air nozzle 14. Of course, the invention is not limited to use in an automatic drill but can be incorporated into other pneumatic tools or other systems using a pneumatic motor.

As shown in FIG. 1, the nozzle 14 is inserted into an inlet bushing 16. Also shown are a drill button 18 and a stop button 20 located outside of the drill housing for easy access. A port 22 (shown in FIG. 2) is connected through fitting 23 to a single tube 26. This arrangement allows pressurized air to be passed to an air control system via a single tube 26 inside a drill head 28: Depending on the type of tool, the air control system may include various pistons, valves, and other air actuated devices.

Figure 2:
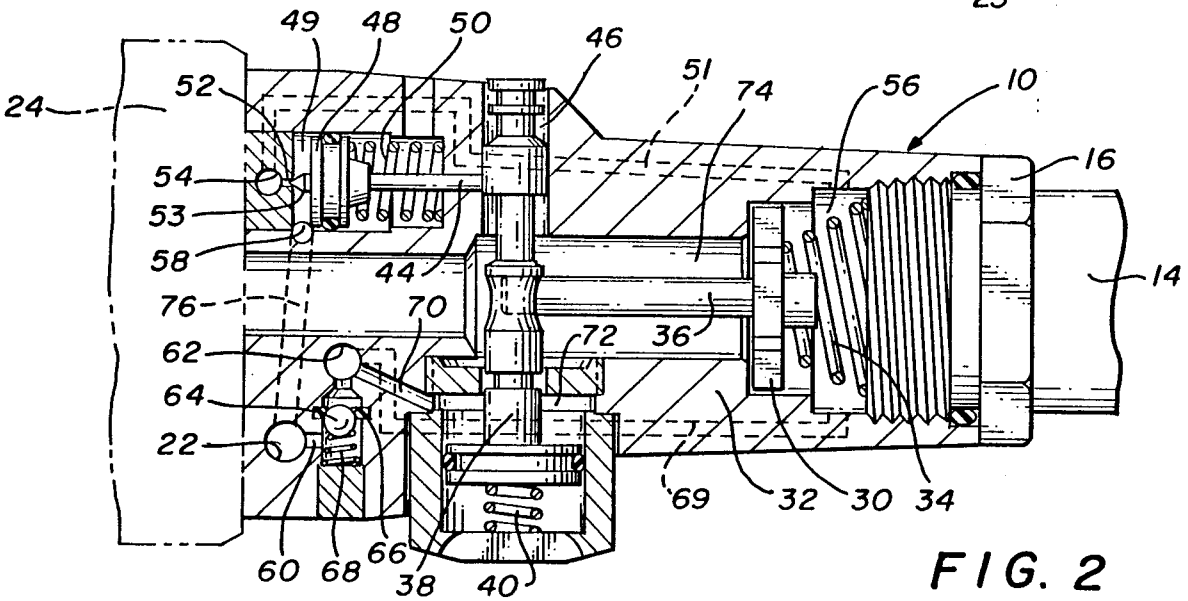
FIG. 2 is a cross-sectional view of one embodiment of the invention.

FIG. 2 shows one embodiment of the present invention. The flow of air to the motor 24 is controlled by a tiltable throttle valve 30. Throttle valve 30 is held closed against a housing 32 by a compression spring 34 and by the pressure of the incoming air stream. Throttle valve 30 is opened by raising or lowering the end of throttle arm 36 opposite throttle valve 30 which then tilts open throttle valve 30 against spring 34.

The end of throttle arm 36 opposite throttle valve 30 is radially inserted into or otherwise connected to throttle piston 38. As throttle piston 38 moves against the compressive force of a throttle spring 40, it lowers the end of throttle arm 36 and tilts open throttle valve 30. Throttle piston 38 has a closed position and an open position (FIG. 2 shows it in the closed position). Throttle piston 38 has a detent recess or slot 46 along its side. When the throttle piston is in the open position, a latch rod 44 can slide into the slot 46 and hold the throttle piston 38 in the open position. Latch rod 44 is attached to a latch piston 48 which moves within cavity 49 against latch spring 50. Latch piston 48 is sealed against pressure loss by seal 57. Pressurized air from an inlet cavity 56 is routed through passage 51, port 54 to metering orifice 52. In a closed position, the tapered end of latch rod 44, or the protrusion 53, seats against the metering orifice 52 and blocks the flow of air through the orifice. In an open position, the air flows from passage 51, through port 54 and metering orifice 52 to cavity 49. The air is then passed through passage 76 to the air control system. The air pressure acting on the face of the piston 48 holds the latch piston in the open position. Latch spring 50 is selected such that it will only be compressed by latch piston 48 when the air pressure in cavity 49 is greater than the minimum desired pressure for shutting off the air flow to motor 24. A supply air pressure of usually 70–100 psig is supplied from the nozzle 14 to inlet cavity 56.

The sensing device comprising the metering orifice 52, latch rod 44, spring 50 and piston 48 provides a preferred embodiment of the present invention. However, in a broad aspect of the invention, this assembly may be replaced by any of many piston or diaphragm actuated devices operating against various types of springs or spring-like elements.

To start the air motor, a supply of pressurized air is routed through passage 69 to start-up port 62. This is done in one embodiment of the invention by depressing drill button 18 momentarily which opens a conventional valve (not shown) in passage 69 to allow air flow from inlet cavity 56 through passage 69, start-up port 62, passage 70 and into throttle cavity 72. In an alternative configuration, start-up port 62 is momentarily pressurized by a remote source. The air pressure in cavity 72 causes throttle piston 38 to move within throttle cavity 72 against throttle spring 40. This movement of throttle piston 38 opens tiltable throttle valve 30 against the force of the air supply pressure and inlet spring 34. The movement of throttle piston 38 to the open position also aligns slot 46 with latch rod 44. Air flows through throttle valve 30 into main air passage 74 and into motor 24 causing it to run.

Momentary air pressure through port 62 also opens ball check valve 64 which is held against o-ring seal 66 by spring 68 in passage 60. Air in passage 60 flows to port 22 and to passage 76. From port 22, the air control system is pressurized through fitting 23 and tube 26 to actuate various valves, pistons and other air pressure components in the air control system. Pressurized air is also conducted through passage 76 to cavity 49.

As the momentary pressure in cavity 49 increases, latch piston 48 will move in cavity 49 by compressing latch spring 50. As latch piston 48 moves in cavity 49 it opens metering orifice 52 to the flow of air. In the embodiment shown in FIG. 2, latch piston 48 can move only so far as to insert rod 44 into slot 46 on throttle piston 38. Latch rod 44 will slide into slot 46 in throttle piston 38 and hold it in the open position So long as the pressure of the air in cavity 49 remains above the predetermined level it will hold latch rod 44 in slot 46 thereby keeping throttle valve 30 open.

When drill button 18 is released, after being held down only momentarily, the flow of pressurized air from inlet cavity 56 through passage 69 to start-up port 62 is cut off. Ball check valve 64 will be forced by spring 68 to seat against O-ring 66 thereby closing passage 60. However, air supplied through metering orifice 52 will keep latch piston 48 and rod 44 in the latched open position and supply air to port 22 and the various components in the air control system. Since the throttle valve 30 remains open, the pneumatic motor 24 continues to run so long as more than the minimum desired pressure is supplied through passage 51 and metering orifice 52 and is present in cavity 49.

If for some reason the supply pressure should drop below the predetermined level, or if the flow through passage 76 to port 22 should increase thereby causing more of a pressure drop across the metering orifice 52, then the pressure in cavity 49 would not be sufficient to hold latch piston 48 against the compressed latch spring 50. Latch piston 48 would move away from throttle piston 38 thereby removing rod 44 from slot 46. Thus, throttle piston 38 would no longer be held in the open position and it would be forced upward by throttle spring 40 thereby closing throttle valve 30, shutting off all air flow through the device 10 to the motor 24 and stopping the motor. The latch spring 50 would continue to move the protrusion 53 into the metering orifice 52 stopping air flow through passage 76, port 22, fitting 23, and tube 26 to the air control system. When the supply pressure increases, drill button 18 may be pushed to re-start the motor and re-pressurize the air control system.

The motor may also be shut off by pressing stop button 20 which may be arranged to open either port 22 or port 58 to the atmosphere. Pushing stop button 20 would have the same effect as a decrease in the supply pressure. The pneumatic tool may also be equipped with an automatic stop which vents the air control system. Other devices could similarly be used to reduce the pressure in the device 10 and stop the flow of air to the pneumatic motor 24.

The construction of metering orifice 52 shown in FIG. 2 also provides a check on instantaneous fluctuations in pressure causing a system shut down. Once cavity 49 is pressurized, it would take some amount of time, at least a fraction of a second, to bleed off the pressure in cavity 49 through metering orifice 52 should the supply pressure in passage 51 fall. Any fluctuation or drop in supply pressure that lasts for a period of time shorter than this bleeding time would not cause the supply of air to the motor or to the air control system to be shut off.

From the foregoing detailed description, it is apparent that the invention describes a device that can be built into a pneumatic tool to shut off the air supply to the motor and to the air control system when the supply air pressure becomes too low for the tool to operate safely and effectively. Having described but a single embodiment of the invention, it will be apparent to those skilled in the art that there may be many changes and modifications to this invention without departing from the spirit and scope of the invention. It may be adapted for any of a number of uses and is not limited to use in connection with an automatic drill as described.

What is claimed:

1. An apparatus for shutting off an air supply to a pneumatic motor when the supply air pressure drops below a desired level, the apparatus comprising:

a main air passageway for conducting pressurized air from an external source to the pneumatic motor;

a throttle valve located in said passageway for controlling the flow of air to the pneumatic motor, said throttle valve having an open and a closed position;

a piston chamber;

a throttle piston in said piston chamber which controls said throttle valve and said piston being movable between a closed position in which said throttle valve is closed and an open position in which said throttle valve is open;

spring means for biasing the throttle piston to the closed position;

latching means for holding the throttle piston in the open position against the bias of said spring means;

sensing means for sensing a drop in the air pressure introduced into said main air passageway; and said sensing means being attached to said latching means such that when the supply air pressure drops below a desired level said sensing means causes said latching means to release said throttle piston and allow said spring means to move said throttle piston to the closed position thereby closing said throttle valve to the flow of air.

2. The apparatus of claim 1 wherein said latching means includes a latching rod and said throttle piston having a detent recess for receiving said latching rod, said latching rod being attached to said sensing means and slidably engageable in said detent recess when the throttle piston is in the open position.

3. The apparatus of claim 2 wherein the sensing means includes a control passageway, a cylinder cavity, a latch piston slidable within said cylinder cavity, a latch spring, and said cylinder cavity receiving supply air through the control passageway from the main air passageway without obstruction, said latching rod being attached to the latch piston and said latch spring biasing said latch piston in a direction that disengages said latching rod from said detent.

4. The apparatus of claim 3 wherein the sensing means also includes a metering orifice positioned between the control passageway and the cylinder cavity, and closure means associated with said metering orifice to close the orifice when the throttle piston is in the closed position and open the orifice when the throttle piston is in the open position.

5. The apparatus of claim 4 contained within a portable pneumatic tool.

6. The apparatus of claim 4 contained within an automatic drill.

7. The apparatus of claim 4 further comprising start-up means that includes means for pressurizing the cylinder cavity.

8. The apparatus of claim 1 wherein said sensing means includes a control passageway, a latch piston, a cylinder cavity, and a latch spring, said latch piston being slidable within said cavity against said latch spring, and said cylinder cavity receiving supply air through the control passageway from the main air passageway such that the air pressure within the cylinder cavity forces the latch piston against the latch spring and activates the latching means.

9. The apparatus of claim 8 wherein the sensing means also includes a metering orifice positioned between the control passageway and the cylinder cavity.

10. The apparatus of claim 1 contained within a pneumatic tool.

11. The apparatus of claim 10 further comprising an air control system in fluid communication with said sensing means, said air control system acting to control the operation of said pneumatic tool.

12. The apparatus of claim 11 wherein said air control system is connected with said sensing means by a single air line.

13. The apparatus of claim 11 wherein said sensing means also senses a drop in pressure within the air control system below a predetermined level and acts to shut off the flow of air to the air control system when the pressure drops below the predetermined level.

14. The apparatus of claim 13 wherein said air control system includes a stop device which vents the pressure in the air control system.

15. The apparatus of claim 11 contained within a pneumatic tool.

16. The apparatus of claim 15 further comprising an air control system for controlling the operation of the tool and the air control system being connected with said cylinder cavity by a single air line.

17. The apparatus of claim 11 contained within an automatic drill.

18. The apparatus of claim 1 further comprising start-up means for moving the throttle piston from the closed position to the open position.

19. The apparatus of claim 18 wherein the start-up means includes a means for conducting pressurized air to the piston chamber of the throttle piston such that the air pressure in the chamber forces the throttle piston against the spring means.

20. An apparatus for shutting off an air supply to a pneumatic motor when the air pressure falls below a desired level, comprising:

a main air passage for supplying pressurized air from an external source to the motor;

a throttle valve for controlling the flow of air through the main air passage to the motor;

a throttle piston chamber;

a throttle piston that moves within said piston chamber from a closed position to an open position, said throttle piston controlling the throttle valve;

a throttle spring for biasing the throttle piston to the closed position;

said throttle piston having a detent recess;

a latch rod slidably engageable within said detent recess in the throttle piston when the throttle piston is in the open position so as to hold the throttle piston in the open position;

a cylinder cavity;

a latch piston movable within said cylinder cavity and said latch rod being attached to said latch piston;

a latch spring for biasing said latch piston toward a closed position;

a control passage for conducting pressurized air from the main air passage to the cylinder cavity of the latch piston; and a metering orifice interposed between the control passage and the cylinder cavity for controlling the flow of air into and out of said cavity;

whereby with said throttle piston in the open position, the air pressure in said cylinder cavity when above a desired level forces the latch piston against said latch spring such that it causes the latch rod to engage within said detent recess in the throttle piston, and when the air pressure in said cylinder cavity is below a desired level said latch spring moving the latch piston within said cavity so as to withdraw the latch rod from the detent recess in the throttle piston, and said throttle piston being biased by the throttle spring to the closed position.

* * * * *